US005170723A

United States Patent [19]

Lewkowicz

[11] Patent Number: 5,170,723

[45] Date of Patent: Dec. 15, 1992

[54] SHELF-MOUNTING SYSTEM

[76] Inventor: Mike Lewkowicz, 43 Lambert Johnson Dr., Wayside, N.J. 07712

[21] Appl. No.: 747,455

[22] Filed: Aug. 12, 1991

Related U.S. Application Data

[63] Continuation of Ser. No. 580,803, Sep. 11, 1990, abandoned.

[51] Int. Cl.[5] ..... A47B 5/00

[52] U.S. Cl. ..... 108/152; 211/187

[58] Field of Search ..... 108/30, 111, 152; 211/134, 187, 189

[56] References Cited

U.S. PATENT DOCUMENTS

| | | | |
|---|---|---|---|
| 1,799,441 | 4/1931 | Raymond | 248/248 |
| 2,636,618 | 4/1953 | Merrick | 108/152 |
| 2,842,270 | 6/1958 | Massey | 108/152 |
| 3,675,882 | 7/1972 | Dibble | 108/152 |

FOREIGN PATENT DOCUMENTS

| | | | |
|---|---|---|---|
| 0834737 | 3/1952 | Fed. Rep. of Germany | 211/187 |

*Primary Examiner*—Kenneth J. Dorner
*Assistant Examiner*—Gerald A. Anderson
*Attorney, Agent, or Firm*—Lerner, David, Littenberg, Krumholz & Mentlik

[57] ABSTRACT

A shelf system removably and replaceably mountable on two nails or other support member extending from a wall or other vertical surface at a predetermined oblique angle, allowing for flush engagement between the shelf system and the wall or other vertical surface, and including a pair brackets removably and replaceably mountable on the nails or other support member, disposed for flush engagement with the wall or other vertical surface, and at least one shelf removably and replaceably mountable directly on the brackets.

1 Claim, 4 Drawing Sheets

SHELF-MOUNTING SYSTEM

This is a continuation of application Ser. No. 07/580,803, filed Sep. 11, 1990, now abandoned.

This invention relates generally to wall shelves. More particularly this invention relates to shelf systems which allow for simple removability and replaceability. Still more particularly, this invention relates to such shelf systems which include removable and replaceable shelves.

BACKGROUND OF THE INVENTION

The use of a shelf system in which the mounting bracket is removable and replaceable with respect to a support means, such as a nail, is known in the prior art. U.S. Pat. No. 2,842,270 for example, discloses a wall shelf which is removably attached to the nail supporting the shelf at prop 32. However, in this system, the horizontal shelf 16 is not removable from the vertical post 26, and even more significantly the vertical post 26 is not mounted flush against the wall, so that a significant torque exists at the nail, rendering it impossible to place a considerable weight upon this system without creating an undue pressure upon the nail itself. Furthermore, in this system, the horizontal shelf 16 is not mounted directly on the prop 32, but is instead mounted directly to vertical post 26, and must be permanently secured thereto by a nail 28.

A number of other shelf systems are known in the art which are not removable and replaceable with respect to a support member such as a nail. These include, for example, U.S. Pat. No. 1,799,441, which discloses a shelf bracket which is mounted to the wall by a nail means disposed at a predetermined angle. The bracket can then be used to support a horizontal shelf. The bracket in this case, is not slideably removable from the wall, and is not slotted to adequately support the shelf without additional nails or other connecting means.

Additionally, U.S. Pat. No. 3,675,882 discloses a wall shelf mounting in which the hanging brackets are permanently affixed to the wall and the shelf itself. These brackets are also not removable and replaceable from the wall, and furthermore the shelf itself is not removable or replaceable from the brackets.

Accordingly, it is an object of the present invention to provide an improved shelf system having bracket means which are easily removable from and replaceable to support means.

It is another object of the present invention to provide an improved shelf system having at least one shelf which is easily removable from and replaceable to the bracket means itself.

It is yet another object of the present invention to provide an improved shelf system having at least one shelf which is directly mountable on the bracket means.

It is yet another object of the present invention to provide an improved shelf system which is removable and replaceable as above described and which, in addition, is mountable flush against a wall or other vertical surface.

It is another object of the present invention to provide an improved shelf system which is removable and replaceable as well as sturdy.

The present invention thus, provides a shelf system in which the brackets can be easily removed from the nail supports, and which in one embodiment also provides for the shelf or shelves to be simply slideable into and out of direct engagement with the brackets. The present invention also discloses a shelf system which provides for maximum shelf support strength combined with these features, since the brackets, which include all vertical members of the shelf system, are mounted flush against the wall. Additionally, the present invention is not limited to the use of a single horizontal shelf, but a number of horizontal shelves can be used with the same shelf mounting system by simply adding additional aligned slots into the front edge of the brackets, which are elongated while remaining flush against the wall substantially along their entire length.

SUMMARY OF THE INVENTION

In accordance with the present invention an improved shelf system is provided which is removably and replaceably mountable on at least one nail or other support means and which is disposed flush against a wall or other vertical surface comprising, bracket means which are removably and replaceably mountable on the nail or other support means, the bracket means being disposed for flush engagement with the vertical surface, and shelf means which is removably and replaceably mountable directly on the bracket means.

In accordance with one aspect of the present invention, an improved shelf system is provided in which the removably and replaceably mounted bracket means includes a planar back edge disposed for flush engagement with a wall or other vertical surface, and an aperture which extends inwardly from the planar back edge of the bracket at a predetermined oblique angle allowing for the removable and replaceable mounting on the nail or other support means. A front edge remote from the planar back edge, contains slots acting as shelf support means for supporting a shelf therefrom.

In accordance with another aspect of the present invention, an improved shelf system is provided in which the shelf means is removably and replaceably mounted directly on the bracket means and includes a horizontal planar shelf, and slots extending normal to the back edge of the shelf disposed for removable and replaceable engagement with the shelf support means.

In accordance with another aspect of the present invention, an improved shelf system is provided in which the shelf support means includes slot means which extend inwardly from the front edge of the brackets and disposed normal to the vertical surface. The slot means being sized and shaped for removable and replaceable connection with the slots on the shelf means.

In accordance with one embodiment of the present invention, an improved shelf system is provided in which the support means comprises a pair of nails affixed to a wall or other vertical surface at a predetermined oblique angle, and in which bracket means comprises a pair of equally spaced brackets aligned for slideable engagement with the pair of nails affixed to the wall, thereby allowing for mounting flush against the wall. In accordance with this embodiment, along the back edge of each bracket there is provided a sized and shaped predrilled hole that extends inward, and which serves as the removable and replaceable mounting location for the nail. The front edge of each bracket is thus disposed with at least one sized and shaped slot, extending normal to the wall, with each slot being coordinated with a corresponding slot on the other bracket, in matching planar alignment therewith with respect to their x-axis location after they have been mounted on the wall. These slots thus allow for the removable and replaceable connection directly between the brackets and the shelf or shelves by means of the shelf including corresponding slots extending from the back edge to the outside edge of the shelf normal to the wall. The slots in the shelf or shelves are thus disposed to align or mate with the slots in the brackets to allow for proper coordination of the shelf or shelves with respect to the brackets and the wall.

The present invention will be more clearly understood when read in conjunction with the detailed description and the accompanying drawings which follow.

DETAILED DESCRIPTION

Figure 1:
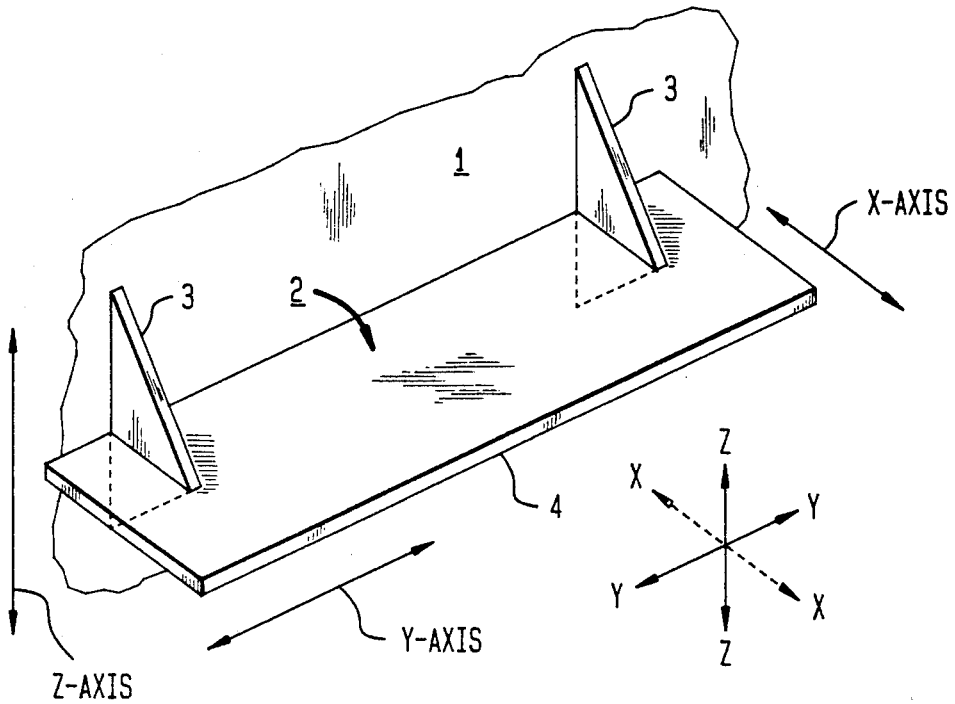
FIG. 1 is a perspective view of a shelf system in accordance with the present invention shown in assembled mounted on a wall.

Referring to the drawings, in which like reference numerals refer to like portions thereof, FIGS. 1–11 show one preferred form of a shelf system generally designated by reference numeral 2 in accordance with the present invention.

Shelf system 2, as illustrated, includes a pair of brackets 3*a* and 3*b* and a shelf 4 extending therebetween.

Those skilled in the art will readily appreciate from the description which follows, that while the drawings illustrate a shelf system including two brackets 3*a* and 3*b* and one planar shelf 4, the bracket shape and the number of brackets can easily be altered to accommodate two or more shelves of similar or different shape.

In the preferred form of the present invention, brackets 3*a* and 3*b* are identical. Thus, any particular reference to one of the identical brackets 3*a* or 3*b* will be for illustration only, and will be understood to apply equally to the unreferenced bracket. Similarly, the associated parts to brackets 3*a* and 3*b* are identical. More particularly, shelf support means 6*a* is identical to 6*b*, back edge 8*a* is identical to 8*b*, aperture 9*a* is identical to 9*b*, and nail 5*a* is identical to 5*b*. Slots 11*a* and 11*b* in shelf 4 are also identical. Any reference to one of the identical components is equally applicable to the associated unreferenced component.

Figure 2:
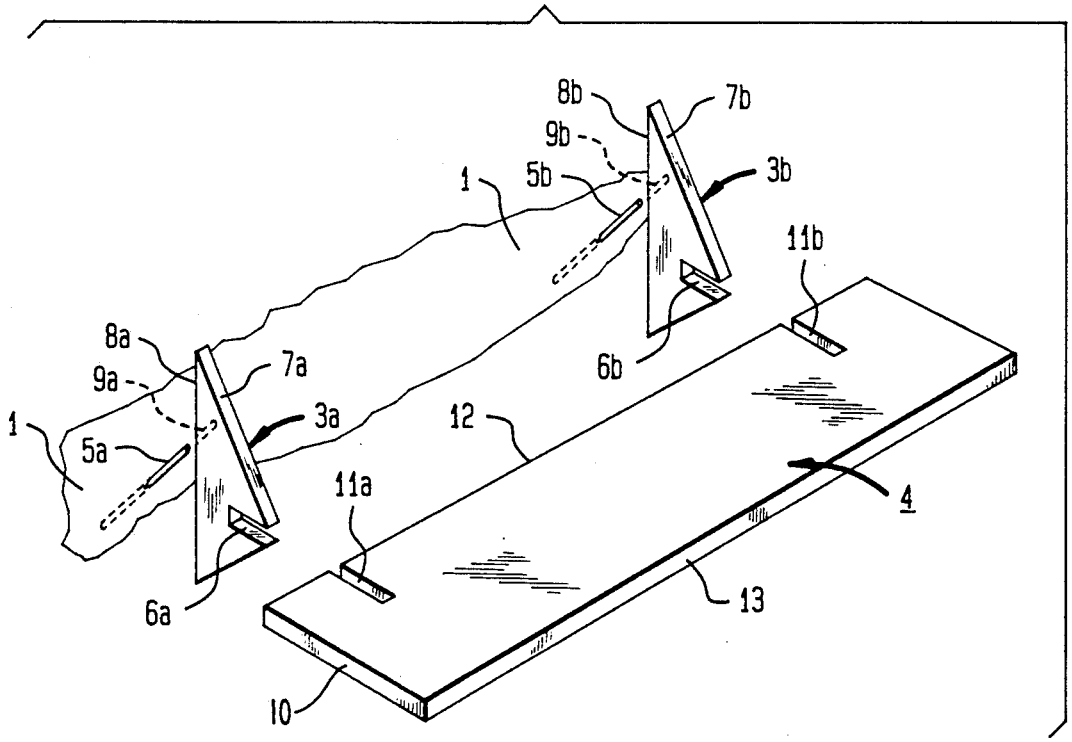
FIG. 2 is a disassembled, perspective view of the shelf system shown in FIG. 1, illustrating the brackets in mountable position with respect to the wall and the planar shelf aligned for removable connection with the brackets.
Figure 4:
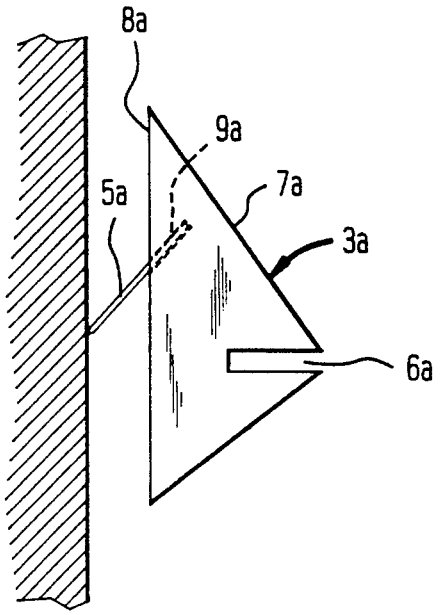
FIG. 4 is a side, perspective view of the bracket shown in FIG. 3, illustrated in mountable position with respect to a wall.
Figure 5:
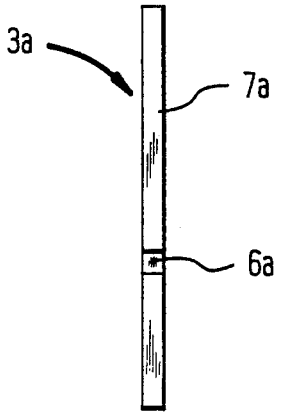
FIG. 5 is a front view of the bracket shown in FIGS. 3 and 4.

Shelf system 2 is shown in FIGS. 1 and 2 as being removably and replaceably mountable on a wall 1. It will be apparent to those skilled in the art that the wall 1 illustrated in FIGS. 1, 2 and 4 is one form of a vertical surface, chosen here to illustrate the mountability of the shelf system 2. The shelf system 2 can similarly be removably and replaceably mounted to any vertical surface suitable for mounting such a shelf system 2.

FIGS. 3, 4, 5, and 6 show that the respective brackets 3*a* and 3*b* are each formed to provide removable and replaceable mounting on a support member, such as a nail 5*a*, protruding at a predetermined oblique angle from a wall 1, or other vertical surface, and furthermore that shelf 4 illustrated in FIGS. 7, 8, 9, 10, and 11, is removably and replaceably mountable on brackets 3*a* and 3*b*.

Figure 3:
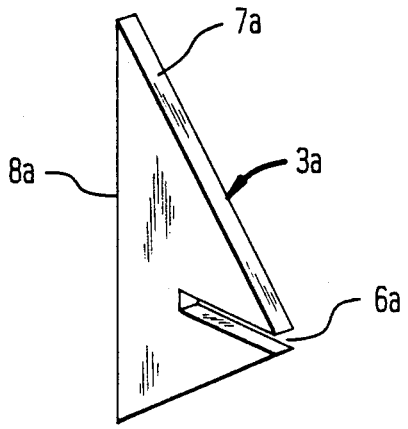
FIG. 3 is a side, perspective view of a bracket of the shelf system shown in FIGS. 1 and 2.
Figure 6:
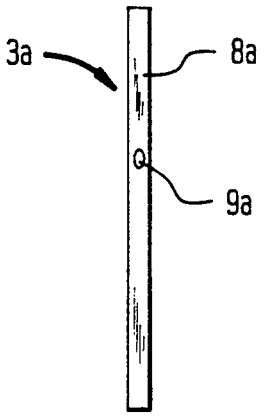
FIG. 6 is a rear view of the bracket shown in FIGS. 3 and 4.

The back edge 8*a* of bracket 3*a* is planar, as shown in FIGS. 3, 4, and 6, to allow for flush mounting of bracket 3*a* with respect to the surface of wall 1, as best illustrated in FIG. 4. An aperture 9*a* extending inwardly at a predetermined oblique angle from the back edge 8*a* of bracket 3*a*, is the means which provides bracket 3*a* with the removable and replaceable characteristic with respect to nail 5*a* extending from wall 1 as illustrated in FIG 4. Thus, aperture 9*a* is dimensioned such that the entire nail, which might include a nail head portion, can be readily accommodated slideably within the aperture 9*a*. Bracket 3*a* can thus be readily lifted off of the nail 5*a* which is attached to the wall 1.

Extending inwardly from the front edge 7*a* of bracket 3*a* and normal to the front edge 7*a* is shelf support 6*a*, which is best illustrated in FIGS. 3 and 4. Each shelf support 6*a* consists of a sized and shaped slot disposed for removable and replaceable engagement with a shelf 4.

Figure 7:
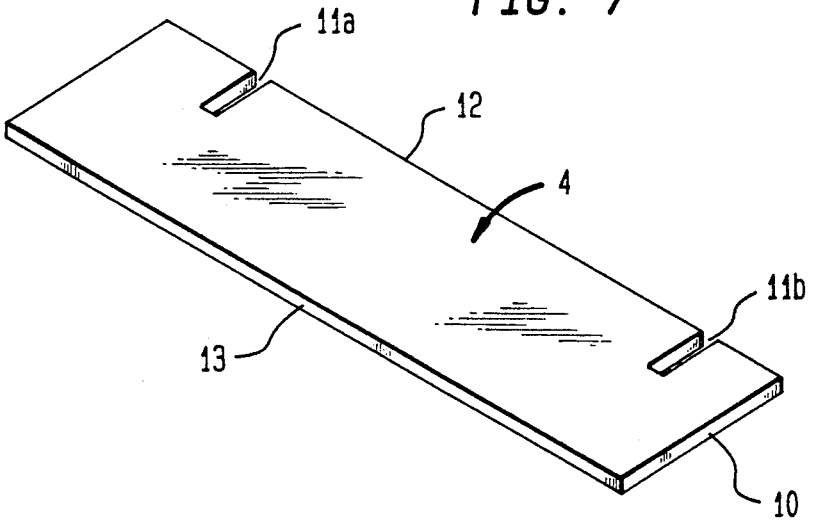
FIG. 7 is a top perspective view of the shelf of the shelf system shown in FIGS. 1 and 2.
Figure 8:
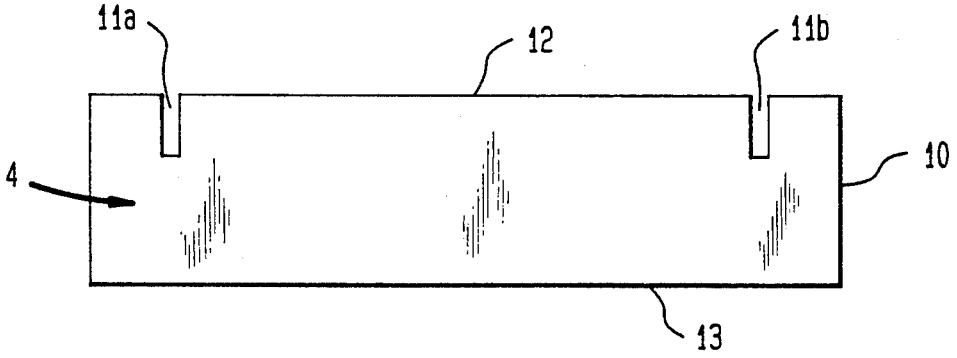
FIG. 8 is a top plan view of the shelf shown in FIG. 7.
Figure 9:
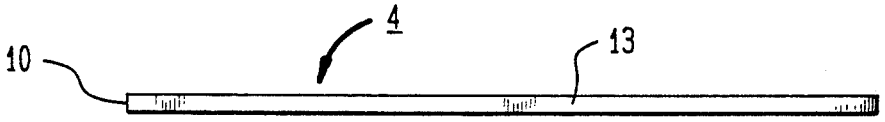
FIG. 9 is a front view of the shelf shown in FIGS. 7 and 8.
Figure 10:
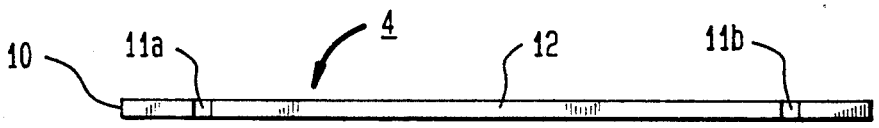
FIG. 10 is a rear view of the shelf shown in FIGS. 7, 8, 9.
Figure 11:
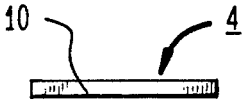
FIG. 11 is a side view of the shelf shown in FIGS. 7, 8, 9 10.

FIG. 7 thus, shows a shelf 4 with front edge 13, side edges 10, and slots 11*a* and 11*b* extending outwardly, normal to the back edge 12 of the shelf 4.

The slots 11*a* and 11*b* can therefore be aligned with the shelf support means or corresponding slots 6*a* and 6*b* in the brackets 3*a* and 3*b*, and the slots are sized and shaped accordingly to allow the shelf 4 to be directly mounted on the brackets 3*a* and 3*b* while remaining removable and replaceable with respect to the brackets 3*a* and 3*b*.

The dimensions of the slots 11*a* and 11*b* in the shelf 4 and shelf support means 6*a* and 6*b* in the brackets 3*a* and 3*b*, are sized and shaped to correspond precisely so that upon mounting of shelf 4 on brackets 3*a* and 3*b*, slots 11*a* and 11*b* engage with shelf support means 6*a* and 6*b* in a secure manner such that each wall is in contact with an adjoining wall, thereby preventing movement of the shelf 4 in the Y-axis and z-axis, but still allowing easy slideable disengagement of shelf 4 from brackets 3*a* and 3*b* in the horizontal x-axis, as defined in FIG. 1.

Thus, the present invention discloses a shelf system 2 with brackets 3*a* and 3*b* that are removably and replaceably mountable on nails 5*a* and 5*b*, which protrude at a predetermined oblique angle from wall 1, and a shelf 4 which is removably and replaceably mountable with respect to brackets 3*a* and 3*b*. The shelf 4 is directly mounted on the brackets 3*a* and 3*b* while the brackets 3*a* and 3*b*, including all vertical members, remain mounted flush against the wall 1, thereby enabling this improved shelf system to be sturdy as well as completely removable and replaceable.

Since the brackets 3*a* and 3*b* include all vertical members and are mounted flush against the wall 1, the resultant torque at the mounting point between the nails 5*a* and 5*b* and the apertures 9*a* and 9*b* in the brackets 3*a* and 3*b* will be at a minimum as a result of the minimized distance between the applied forces and the mounting point. In a system where the bracket extends away from the wall along the x-axis and is connected to a separate vertical member which is then connected to a horizontal shelf, the probability of increasing the distance between forces applied normal to the horizontal shelf and the mounting point increases, thereby resulting in an increased torque at the mounting point and ultimately, a less reliable shelf.

The shelf system as described herein, can be constructed of any material suitable for fulfilling the support purposes generally required of shelves and brackets. The shelf or shelves do not have to be constructed from the same material as the brackets. Suitable materials include plexiglass, plastic wood, metal and any other formable material capable of performing support functions normally required of shelves and brackets.

Figure 12:
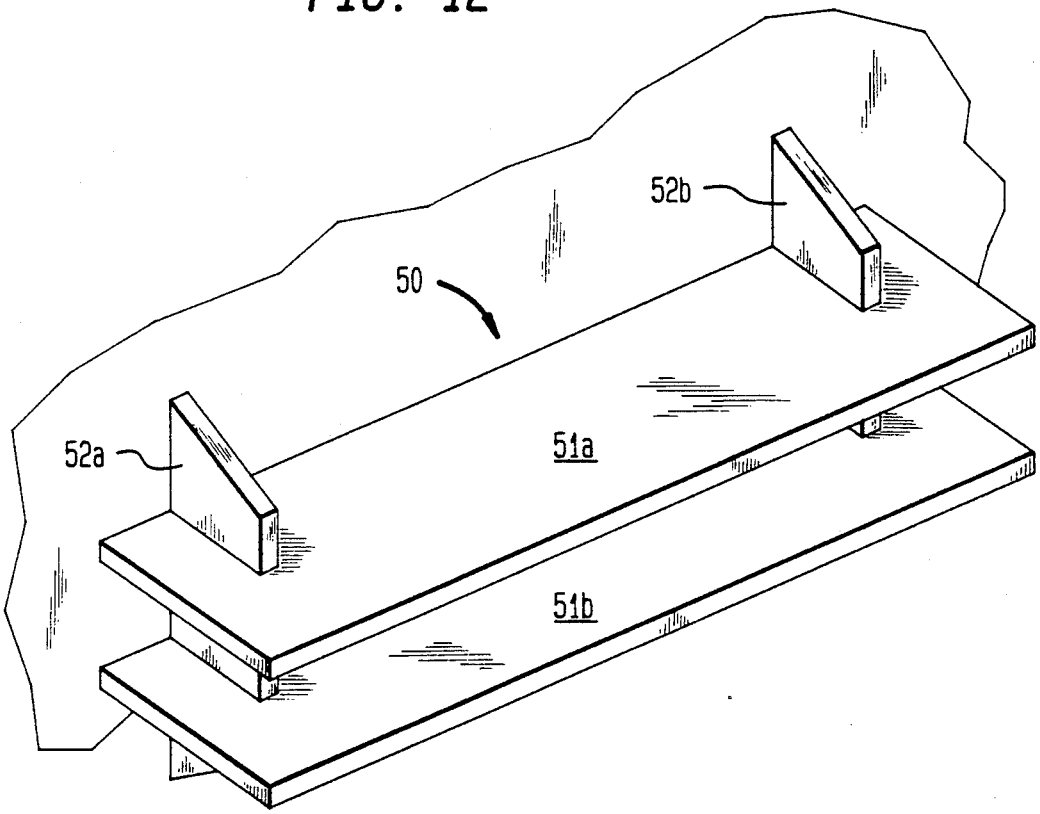
FIG. 12 is a perspective view of another embodiment of a shelf system shown in assembled position mounted on a wall, particularly illustrating a shelf system including two shelves.

FIG. 12 illustrates another embodiment of the present invention showing a shelf system mounted on a vertical surface and including two shelves and two brackets.

Those skilled in the art will readily appreciate that FIG. 12 is just one of many possible embodiments of the present invention. Additional embodiments of the claimed shelf system can be shown by varying the number of shelves and brackets as well as the shape of the shelves and brackets.

Thus, FIG. 12 shows a shelf system generally designated by reference numeral 50 in accordance with the present invention. Shelf system 50 is shown in FIG. 12 as including two shelves 51*a* and 51*b*, and two brackets 52*a* and 52*b*. The shelves 51*a* and 51*b* and brackets 52*a* and 52*b* have the same removable and replaceable characteristics as illustrated and described in the earlier embodiment of the present invention and the claims.

While two preferred embodiments of the invention have been described, such descriptions are only by way of illustration and not of limitation to the scope thereof as set forth in the following claims.

What is claimed is:

1. A shelf system removably and replaceably mountable on support means extending from a vertical surface, said shelf system disposed for flush engagement with said vertical surface consisting of:

A. at least two bracket means for removably and replaceably mounting on said support means, said bracket means disposed for flush engagement with said vertical surface and including:
   1. a planar back edge disposed for flush engagement with said vertical surface;
   2. a front edge remote from said planar back edge;
   3. at least one shelf support means for supporting a shelf means, said shelf support means including a first slot extending inwardly from said front edge of said bracket means, said at least one first slat disposed normal to said front edge and said planar back edge of said bracket means, and said slot means being sized and shaped for removable and replaceable connection with said shelf means;
   4. an aperture extending inwardly from said planar back edge of said bracket means at a predetermined oblique angle, for removable and replaceable connection with said support means and being located at a predetermined position on said bracket means at a location above all said shelf support means whereby the weight of said shelf means is below said shelf support means;

B. a support means for every bracket means, said support means having a first end adapted to be anchored in a vertical surface at an oblique angle thereto such that a second end of said support means is insertable into said means defining an aperture in each of said bracket means at an angle which is oblique to said bracket means; and C. a least one shelf removable and replaceably mounted directly on said bracket means, each said shelf disposed for normal and flush engagement with said vertical surface and including a horizontal extending planar surface a back edge, a front edge, and a second slot in said back edge and extending normal to said back edge of said second slot disposed for direct engagement with said bracket means and sized and shaped for removable and replaceable engagement therewith, and said front edge being spaced from said front edge of said bracket means so as to provide shelf space beyond said front edge of said bracket means.

* * * * *

UNITED STATES PATENT AND TRADEMARK OFFICE

CERTIFICATE OF CORRECTION

PATENT NO. : 5,170,723

DATED : December 15, 1992

INVENTOR(S) : Mike Lewkowicz

It is certified that error appears in the above-indentified patent and that said Letters Patent is hereby corrected as shown below:

Column 6, line 15, delete "slat" and insert therefor --slot--.
line 22, delete ","
line 35, "removable" should read --removably--.

Signed and Sealed this

Twenty-sixth Day of October, 1993

Bruce Lehman

*Attest:*

BRUCE LEHMAN

*Attesting Officer*

*Commissioner of Patents and Trademarks*